United States Patent [19]

Potter et al.

[11] 4,232,644

[45] Nov. 11, 1980

[54] FUEL PUMPING APPARATUS

[75] Inventors: James C. Potter; Stanislaw J. A. Sosnowski, both of London, England

[73] Assignee: Lucas Industries Limited, Birmingham, England

[21] Appl. No.: 971,495

[22] Filed: Dec. 20, 1978

[30] Foreign Application Priority Data

Jan. 19, 1978 [GB] United Kingdom ..... 2178/78

[51] Int. Cl.[3] ..... F02M 39/00; F04B 29/00

[52] U.S. Cl. ..... 123/450; 123/495; 417/462

[58] Field of Search ..... 123/139 BC, 139 BE, 123/139 BD, 139 AL; 417/462, 504

[56] References Cited

U.S. PATENT DOCUMENTS

| | | | |
|---|---|---|---|
| 2,465,138 | 3/1949 | Van-Tuyl | 123/139 BC |
| 3,489,093 | 1/1970 | Thornber | 123/139 AL |
| 3,918,853 | 11/1975 | Drori | 123/139 BC |
| 4,146,003 | 3/1979 | Drori | 123/139 AL |

*Primary Examiner*—Charles J. Myhre
*Assistant Examiner*—Magdalen Moy

[57] ABSTRACT

A fuel injection pumping apparatus includes a delivery valve interposed between the outlet of an injection pump and a plurality of outlet ports to which fuel is delivered in turn at successive delivery strokes of the injection pump. Communication with the outlet ports is established through a delivery passage and in order to minimize the loading of the spring which biases the delivery valve to the closed position, a branch passage is provided and which opens to an outlet port in advance of the communication with that outlet port of the main delivery passage. As a result some fuel flows through the branch passage the size of which in relation to the outlet port is such that fuel will be gradually diverted by way of the delivery valve and the main delivery passage during delivery of fuel. As a result the movement of the valve member of the delivery valve is less rapid and the stress on the spring is reduced.

3 Claims, 2 Drawing Figures

FUEL PUMPING APPARATUS

This invention relates to liquid fuel injection pumping apparatus for supplying fuel to internal combustion engines and of the kind comprising an injection pump, a rotary distributor member housed in a body, the injection pump and distributor member being driven in use, in timed relationship with an associated engine, the distributor member including a delivery passage through which fuel delivered by the injection pump flows and which registers in turn with a plurality of outlet ports which in use are connected to injection nozzles of the associated engine respectively during successive delivery strokes of the injection pump and a spring loaded delivery valve mounted within the distributor member and positioned in said passage, said delivery valve being opened during the delivery of fuel by the injection pump and when the delivery of fuel by the injection pump has ceased, closing to allow a limited volume of fuel to return to the injection pump from the outlet ports.

Such apparatus is well known in the art but it has the disadvantages that the spring which loads the delivery valve is subjected to considerable stress which can result in premature failure. As only one delivery valve is provided, the spring is stressed each time the injection pump partakes of a delivery stroke and the stress to which it is subjected is high owing to the high acceleration and the high velocity imparted to and achieved by the valve member at the start of and during the delivery of fuel.

The object of the invention is to provide an apparatus of the kind specified in a simple and convenient form.

According to the invention in an apparatus of the kind specified a branch passage is formed in the distributor member, the branch passage communicating with the injection pump, said branch passage extending to the periphery of the distributor member for communication with an outlet port in advance of the communication of the same outlet port with the aforesaid passage, the size of the outlet ports and the spacing of the passages about the periphery of the distributor member being such that the initial volume of fuel delivered by the injection pump flows to the outlet port by way of said branch passage, the fuel flow than being gradually diverted to the aforesaid passage to achieve gradual opening of the delivery valve.

Figure 1:
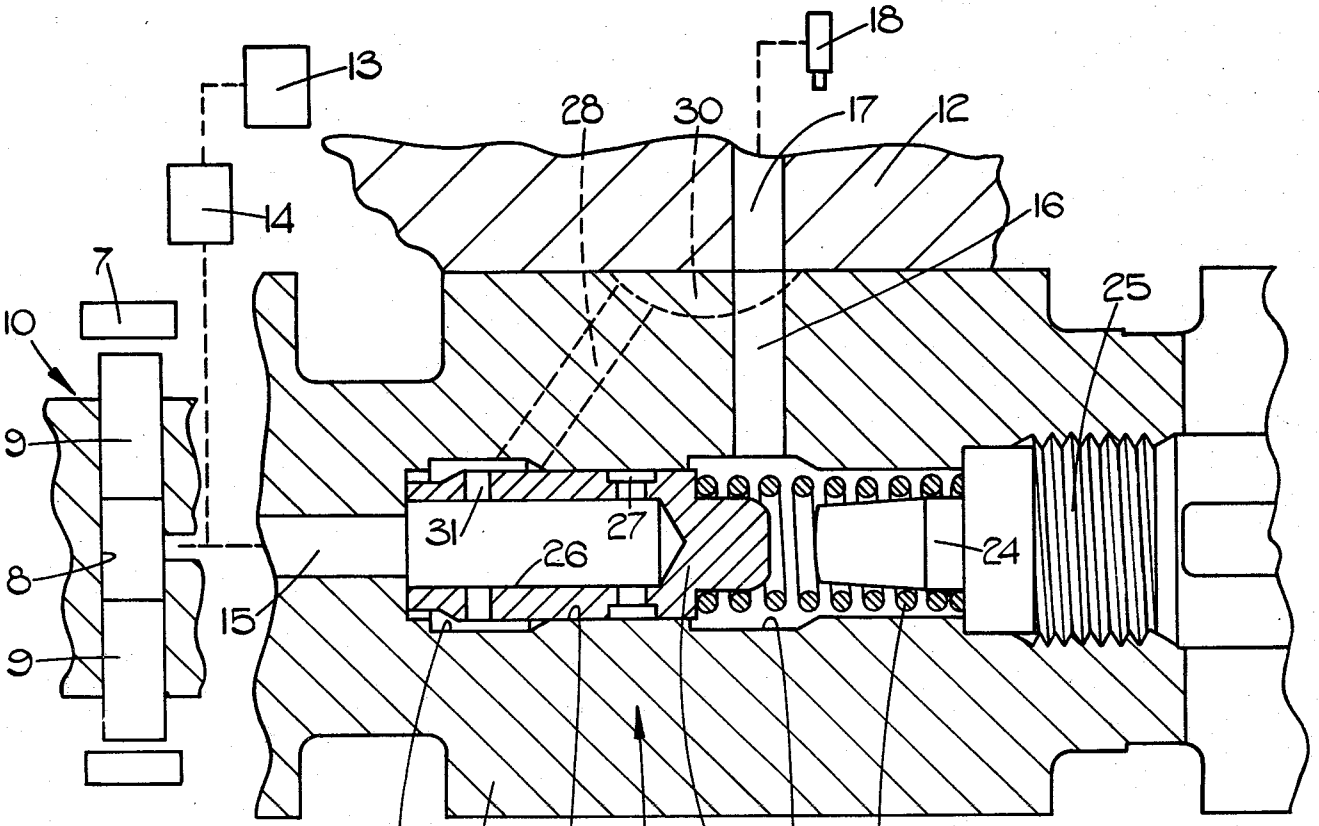
Figure 2:
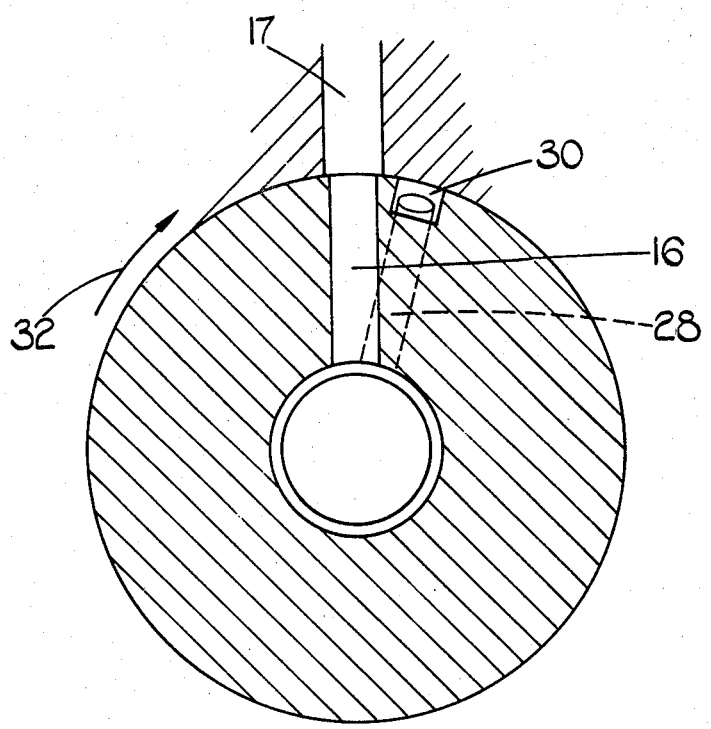

One example of a fuel injection pumping apparatus in accordance with the invention will now be described with reference to the accompanying drawings in which:

FIG. 1 is a sectional side elevation of a portion of the apparatus with the remaining parts of the apparatus being shown in block form and FIG. 2 is a section through the portion of the apparatus seen in FIG. 1.

Referring to FIG. 1 of the drawings, the apparatus includes an injection pump 10, a distributor member 11, and a body portion 12, of the apparatus. The distributor member is mounted for rotation within the body portion of the apparatus and in use is driven in timed relationship with the associated engine. Conveniently the injection pump 10 comprises a pair of plungers 9 which are disposed in a transversely extending bore 8 formed in the distributor member 11 and which through rollers (not shown) at their outer ends are moved inwardly by the action of cam lobes formed on the internal periphery of an annular cam ring 7 which is mounted within the body portion. The plungers move inwardly to effect a delivery stroke and are moved outwardly during a filling stroke by the action of fuel under pressure obtained from a supply pump 13 the quantity of fuel delivered by the supply pump to the injection pump being controlled by the throttle 14.

The transverse bore 8 in the distributor member communicates with a longitudinal passage 15 also formed in the distributor member and conveniently the fuel is supplied to the longitudinal passage 15 from the supply pump 13 by way of an inlet port formed in the body portion 12 and a plurality of inlet passages formed in the distributor member and which communicate with the passage 15. The inlet port and one of the inlet passages are brought into register to achieve supply of fuel to the injection pump.

The longitudinal passage 15 communicates with a delivery passage 16 formed in the distributor member and extending outwardly to the periphery thereof for communication in turn with a plurality of outlet ports 17 which are formed in the body portion 12. In use, the outlet ports 17 communicate with the injection nozzle 18 respectively of the associated engine. A delivery valve generally indicated at 19 is provided in the distributor member to control the flow of fuel through the delivery passage 16 and in particular to control the amount of fuel which flows back from the outlet port 17 when the delivery of fuel by the injection pump has ceased.

The delivery valve comprises a valve member 20 which is located in the manner of a piston, in a cylinder 21 defined by an enlargement of the passage 15. The cylinder 21 is provided with an enlarged portion 22 from which extends the passage 16 and the enlarged portion 22 forms a step with the wall of the cylinder 21. A spring 23 acts on the valve member 20, the latter being provided with a reduced head to locate the spring at one end, the other end of the spring being located about an abutment 24 which is mounted on an end plug 25 the latter serving to seal the end of the cylinder 21.

A further step is defined between the passage 15 and the cylinder 21 and the spring 23 urges the valve member into contact with the step.

Formed within the valve member is a blind bore 26 which is in constant communication with the passage 15. The bore 26 communicates with a circumferential groove 27 formed on the valve member near its end adjacent the spring, the groove communicating with the bore by way of transverse drillings. The apparatus so far described is well known and in use, when fuel is supplied by the injection pump 10 the valve member moves against the action of the spring 23. In so doing fuel is displaced through the passage 16 to an outlet 17 communicating with the passage 16. The movement of the valve member 20 ceases when the longitudinal groove 27 is exposed beyond the step defined between the cylinder 21 and the enlarged portion 22. During such movement the spring 23 is subject to considerable stress because the valve member 20 undergoes rapid acceleration to achieve a high velocity as the fuel is delivered by the injection pump.

In order to minimise the stress a branch passage is provided which is brought into register with the particular outlet port 17 before the passage 16. The branch passage is in constant communication with the passage 15.

Conveniently, the branch passage is formed by a passage 28 drilled in the distributor member and communicating with an enlarged portion 29 of the cylinder 21, the enlarged portion 29 being situated adjacent the end of the cylinder 21 remote from the plug 25. The passage 28 also communicates with a longitudinal groove 30 which is machined in the surface of the distributor member. Moreover, the valve member is provided with further transverse drillings 31, which place the passage 28 in constant communication with the passage 15. As will be seen in FIG. 2, the direction of rotation of the distributor member is indicated by the arrow 32 and it will be seen that the groove 30 is positioned in advance of the delivery passage 16. The spacing between the groove 30 and the delivery passage 16 in relation to the size of the outlet ports 17 is such that initially the groove 30 only communicates with the port 17 and this is followed by an overlap period during which both the groove 30 and passage 16 communicate with the port. This is followed by a period during which only the passage 16 communicates with the port. It will be noted movement of the plungers does not occur until the groove 30 is in communication with the outlet port 17. During the initial movement of the plungers all fuel flows by way of the branch passage but as the distributor member rotates, the registration of the groove 30 with the port 17 decreases and whilst this is occurring the registration of the passage 16 with the port 17 takes place and gradually increases. The fuel is therefore diverted from the branch passage 28 and the diverted fuel moves the valve member 20 towards the open position. The acceleration to which the delivery valve is subjected is considerably less than in the case where the branch passage is omitted. Moreover, its velocity is also reduced. As a result the stress on the spring is also reduced. When the injection pump ceases to deliver fuel then the delivery valve operates to permit only a limited quantity of fuel to return from the outlet 17 towards the injection pump, the actual quantity being determined by the stroke of the valve member 20 following the covering of the groove 27 by the step between the wall of the cylinder 21 and the enlarged portion 22.

It is usual to arrange that the delivery valve always moves its maximum stroke before the termination of the delivery of fuel by the injection pump. This ensures that a predetermined volume of fuel flows back towards the injection pump however must fuel is supplied by the injection pump during the preceding pumping stroke.

We claim:

1. A liquid fuel injection pumping apparatus for supplying fuel to internal combustion engines and of the kind comprising an injection pump, a rotary distributor member housed in a body, the injection pump and distributor member being driven in use, in timed relationship with an associated engine having injection nozzles, the distributor member including a delivery passage through which fuel delivered by the injection pump flows and which registers in turn with a plurality of outlet ports which in use are connected to the injection nozzles of the associated engine respectively during successive delivery strokes of the injection pump, a spring loaded delivery valve mounted within the distributor member and positioned in said passage, said delivery valve being opened during the delivery of fuel by the injection pump and when the delivery of fuel by the injection pump has ceased, closing to allow a limited volume of fuel to return to the injection pump from the outlet ports, a branch passage formed in the distributor member, the branch passage communicating with the injection pump, said branch passage extending to the periphery of the distributor member for communication with an outlet port in advance of the communication of the same outlet port with the aforesaid passage, the size of the outlet ports and the spacing of the passages about the periphery of the distributor member being such that the initial volume of fuel delivered by the injection pump flows to the outlet ports by way of said branch passage, the fuel flow then being gradually diverted to the aforesaid passage to achieve gradual opening of the delivery valve.

2. An apparatus according to claim 1 in which said delivery valve comprises an axially movable valve member slidable within a cylinder one end of which communicates with the injection pump, a bleed bore formed in the valve member and in constant communication with said one end of the cylinder, a port formed in the wall of the valve member and through which said branch passage communicates with the injection through said bore, and a further port formed in the wall of the valve member, said further port being uncovered beyond a step in the wall of the cylinder after the valve member has moved a predetermined extend.

3. An apparatus according to claim 1 or claim 2 in which said branch passage at its outer end communicates with a longitudinal groove on the periphery of the distributor member, said groove extending axially so as to communicate with the outlet ports in turn.

* * * * *